United States Patent [19]

Stewart

[11] 4,267,905

[45] May 19, 1981

[54] PORTABLE DISPLAY RACK AND SAMPLE CARRYING CASE

[76] Inventor: Oscar Stewart, 12073 N. Elms Rd., Clio, Mich. 48420

[21] Appl. No.: 75,690

[22] Filed: Sep. 14, 1979

[51] Int. Cl.[3] ..... A47B 61/06; A45C 9/00; B65D 5/52

[52] U.S. Cl. ..... 190/13 R; 190/16; 206/44.11

[58] Field of Search ..... 206/44.11, 45.11, 44 R; 190/16, 13 R, 13 E

[56] References Cited

U.S. PATENT DOCUMENTS

| | | | |
|---|---|---|---|
| 421,540 | 2/1890 | Barber . | |
| 722,760 | 3/1903 | Scarborough . | |
| 982,477 | 1/1911 | Cavanagh . | |
| 1,113,818 | 10/1914 | O'Brien . | |
| 1,198,431 | 9/1916 | Forsyth . | |
| 1,224,250 | 5/1917 | Wheary | 190/13 E |
| 1,520,044 | 12/1924 | Wilt | 190/13 R |
| 1,546,489 | 7/1925 | Heimann | 190/13 R |
| 1,741,771 | 12/1929 | Hellman . | |
| 2,639,793 | 5/1953 | Hellman | 190/16 |
| 3,318,462 | 5/1967 | Spiegl et al. | 211/177 |

*Primary Examiner*—William T. Dixson, Jr.
*Attorney, Agent, or Firm*—Basile, Weintraub & Hanlon

[57] ABSTRACT

A portable display rack and sample carrying display case is disclosed. The rack comprises a pair of spaced apart telescoping tubes releasably attached to the carrying case and extending vertically upward therefrom. A plurality of elongated planar shelf supports including a tube engaging aperture formed in one end are slidingly distributed along the length of the tubes. A plurality of shelves extend between the supports. The display rack may be disassembled and stored within the cover of the display case and retained therein by a pair of elastic straps fastened at their ends to an inside surface of the cover.

6 Claims, 3 Drawing Figures

PORTABLE DISPLAY RACK AND SAMPLE CARRYING CASE

BACKGROUD OF THE INVENTION

I. Field of the Invention

The present invention relates to the field of portable display racks, and more particularly, the present invention relates to the field of portable display racks which are collapsible and may be transported in the cover of a sample carrying case. Even more particularly the present invention relates to the field of portable display racks which are collapsible and may be carried in the cover of a sample carrying case, the case serving as a base for the display rack when the rack has been deployed.

II. Description of the Prior Art

Portable foldable display racks have long been known. U.S. Pat. No. 421,540 discloses a fruit stand, which may be folded for storing and displaying fruits.

U.S. Pat. No. 722,760 discloses a folding book case. U.S. Pat. No. 982,477 discloses a portable work supporting rack which when not in use may be folded to occupy a minimum amount of space.

U.S. Pat. No. 1,113,818 discloses a shoe rack which can be readily folded into a compact space when not in use.

U.S. Pat. No. 1,198,431 discloses a rack for displaying shoes which can be folded into a small space when it is not in use.

U.S. Pat. No. 1,741,771 discloses a shipping and display case for saddles. The shipping case serves as the display rack when the front and top cover of the case have been hinged from their closed position.

U.S. Pat. No. 3,318,462 discloses a modular rack for displaying articles of clothing which are hung on clothing hangers and can be knocked down to a compact size for storage when not in use.

None of the above listed patents disclose a carrying case which serves as a base for the displaying rack as well as a container for transporting the disassembled rack and articles to be displayed.

The above listed United States Patents constitute the closest prior art relating to the field of the present invention that is known to the Applicant and his Attorney.

SUMMARY OF THE INVENTION

The portable display rack and sample carrying case of the present invention comprises: a carrying case which serves as a base for the display rack; a pair of spaced apart telescoping tubes; a pair of tube encircling clamps to detachably mount the tubes to the base of the carrying case; a pair of braces which extend between the tubes and the base, a pair of apertures formed in the ends of the case each adapted to receive one end of an associated brace and an aperture formed in each of the tubes to receive the other end of the brace; a plurality of elongated planar shelf supports including a tube engaging aperture formed in one end thereof to slidingly engage the telescoping tubes, the supports distributed along the extended tubes; and a plurality of shelves extending between supports.

The display rack and sample case of the present invention further comprises a rod extending between tubes which is bent at a right angle at the ends thereof to engage the tubes. A rod engaging aperture is formed in each tube above the clamps to receive the rod ends.

When the rod is extended between tubes above the clamps the rod serves as a rest for the heel of shoes or boots which may be deployed between an edge of the case and the rod.

The display rack further includes a pair of end caps snugly engaging an upper end of the tubes, and an upper rod engaging aperture formed at the center of each of the caps. The rod may alternately be deployed between the caps. With the shelves removed the display rack then serves as a means for supporting clothes hung on hangers positioned along the rod.

The cover of the case contains a pair of elastic straps fastened at their ends to an inside surface of the cover for retaining the disassembled rack. The remainder of the sample case may be employed to store and/or transport articles of clothing or shoes and boots etc. to be displayed on the deployed rack.

For a more complete understanding of the present invention reference is made to the following detailed description and accompanying drawing.

Other applications of the present invention will become apparent to those skilled in the field to which this invention pertains, when the accompanying description of the best modes contemplated for practicing the invention are read in conjunction with the accompanying drawings.

BRIEF DESCRIPTION OF THE DRAWING

In the drawing, like reference numbers refer to like parts throughout the several views, and wherein.

DESCRIPTION OF THE PREFERRED EMBODIMENT

Figure 1:
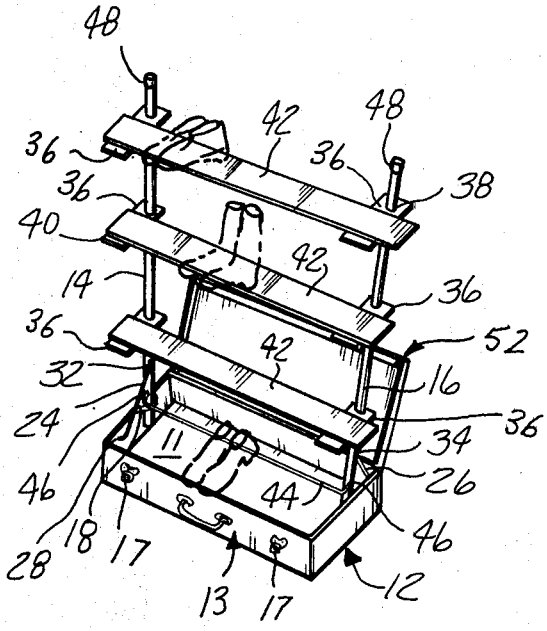
FIG. 1 illustrates the display rack and sample carrying case of the present invention deployed with shelves and boots.
Figure 3:
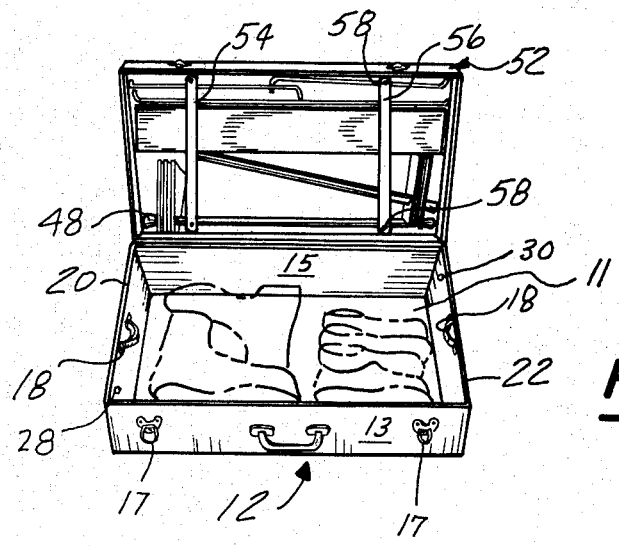
FIG. 3 illustrates the display rack and boots of FIG. 1 stored within the carrying case.

Referring now to the drawing and in particular to FIG. 1 wherein there is illustrated at 10 a preferred embodiment of the present invention comprising a carrying case 12 which serves as a base. The case includes a bottom wall 11 integral with a pair of opposed side walls 20,22, a front wall 13 and a rear wall 15. A cover 52 is hinged to the rear wall 15 and hasps 17 are employed to hold the case closed when desired. A pair of spaced apart telescoping tubes 14,16 are slidingly affixed to the carrying case 12 by means of a pair of tube encircling clamps 18 affixed to opposed inside ends of the case by pop rivets (not shown) which pass through apertures formed in outward extending flanges of the clamps and pass through apertures formed in the ends of the case aligned with the apertures in the flanges to secure the clamps to the ends of the side walls 20,22 (FIG. 3). A pair of braces 24,26 extend between the tubes and the end walls 20,22 of the case. The braces 24,26 are preferably bent at right angles at the ends thereof and engage a pair of apertures 28,30 formed in the ends of the case, and a pair of apertures 32,34 formed in the tubes 14,16.

A plurality of elongated planar supports 36 include a tube engaging aperture 38 formed in one end thereof to slidingly engage the tubes 14,16. The supports 36 are distributed along the length of the tubes, and the supports include an upward projecting end 40 to position a plurality of shelves 42 between the spaced apart supports 36. The upward projecting ends 40 serve to retain the shelf between the tubes 14,16 and the ends 40.

The display rack and sample case further includes a rod 44 extending between the tubes 14,16. The rod 44 has ends bent at right angles to engage the tubes 14,16 and provide a support for the heel of shoes on display. A rod engaging aperture 46 is formed in each tube above the clamps 18 to support the rod 44 between tubes. When the shelves 42 and the rod 44 have been deployed the display rack and sample case serves as a display rack for shoes and boots illustrated in phantom in FIG. 1.

Figure 2:
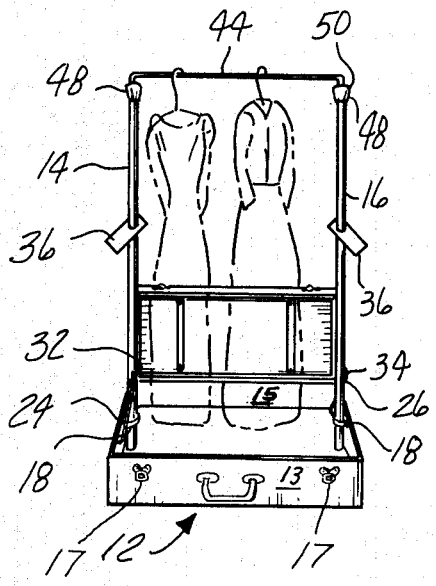
FIG. 2 illustrates the display rack of the present invention deployed as a support for the display of clothing.

The display rack and sample case further comprises a pair of caps 48 snugly engaging an upper end of the tubes 14,16 (FIG. 2). An upper rod engaging aperture 50 is formed in each of the caps 48, and the rod 44 may be deployed between the apertures 50 as illustrated in FIG. 2. With the rod 44 deployed as shown in FIG. 2 and the shelf supports 36 swung away, the display rack of FIG. 2 may be utilized as a support for clothing hung on hangers as illustrated in phantom in FIG. 2.

Referring now to FIG. 3 of the drawing wherein the display rack and sample case of FIG. 1 has been disassembled and the rack and shoes have been stored within the sample case 12. The cover 52 of the case has a pair of elastic straps 54,56 fastened to an inside surface of the cover 52 by pop rivets 58 which pass through aligned apertures formed in the ends of the straps and the cover to secure the straps to the inside surface of the cover. The elastic straps 54,56 secure the disassembled rack to the inside surface of the cover 52. The storage area of the sample case provides ample space to store items to be later displayed such as boots and/or clothing.

There has been described hereinabove a collapsible display rack and sample carrying case in which the display rack may be folded into the sample carrying case and still provide ample room for carrying samples such as clothing and/or shoes. The display rack of the present invention may be deployed with shelves to support various items to be displayed, or it may be deployed as a rack for supporting clothes hangers which support various articles of apparel for display.

Having thus described my invention what I claim is:

1. A portable display rack and sample carrying case including a storage compartment and a hinged cover comprising:

a carrying case comprising a base including a pair of opposed upstanding end walls;

a pair of spaced apart telescoping tubes storable within the case;

a pair of tube encircling clamps mounted to the end walls of the storage compartment to slidingly support the tubes;

a pair of braces extending between the tubes and the end walls;

a plurality of elongated planar shelf supports including a tube engaging aperture formed in one end to slidingly engages the tubes, the shelf supports being distributed along the extending tubes; and a plurality of shelves extending between the shelf supports.

2. The display rack and sample case of claim 1 further comprising:

a rod extending between the tubes supported at each tube above the clamps.

3. The display rack and sample carrying case of claim 2 further comprising a pair of caps snugly engaging an upper end of the tubes;

an upper rod engaging aperture formed in each of the caps; and the rod extending between rod engaging apertures.

4. The display rack and sample case of claim 1 wherein the cover of the case contains a pair of elastic straps fastened at their ends to an inside surface for retaining the disassembled rack.

5. The display rack and sample case of claim 1 further comprising:

the braces bent at right angles at the ends thereof;

each tube having an aperture formed therein to receive an end of the braces; and each end wall of the case having an aperture formed therein to receive another end of the braces.

6. The display rack and sample case of claim 2 further comprising:

the rod bent at right angles at the ends thereof;

a rod receiving aperture formed in each tube above the clamps; and the rod extending between and supported by the rod receiving apertures.

* * * * *